US008571243B2

(12) United States Patent
Komagel et al.

(10) Patent No.: US 8,571,243 B2
(45) Date of Patent: Oct. 29, 2013

(54) METHOD FOR SUPPRESSING FEEDBACK AND FOR SPECTRAL EXTENSION IN HEARING DEVICES

(75) Inventors: Ulrich Komagel, Erlangen (DE); Tom Weidner, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1180 days.

(21) Appl. No.: 11/799,955

(22) Filed: May 3, 2007

(65) Prior Publication Data

US 2007/0269068 A1 Nov. 22, 2007

(30) Foreign Application Priority Data

May 4, 2006 (DE) ..... 10 2006 020 832

(51) Int. Cl.
*H04R 25/00* (2006.01)

(52) U.S. Cl.
USPC ..... 381/317; 381/316; 381/320; 381/94.1; 381/94.3; 381/94.8

(58) Field of Classification Search
USPC ..... 381/98, 119, 316, 71.14, 93, 320, 318, 381/83, 95, 321, 312, 314, 317, 94.1–94.8, 381/71.6, 71.4, 74, 100, 23.1, 60; 455/296, 455/222, 570, 136; 379/406.01–406.16, 52; 700/94; 704/214, 231, 233, 237, 246, 704/270, 275
See application file for complete search history.

(56) References Cited

U.S. PATENT DOCUMENTS 3,518,578 A * 6/1970 Oppenheim et al. ..... 333/14
4,061,875 A * 12/1977 Freifeld et al. ..... 381/72
4,185,168 A * 1/1980 Graupe et al. ..... 381/318
4,419,544 A * 12/1983 Adelman ..... 381/94.3
5,305,307 A 4/1994 Chu
5,394,475 A 2/1995 Ribic
6,157,680 A * 12/2000 Betts et al. ..... 375/285
6,169,813 B1 1/2001 Richardson et al.
2002/0150264 A1 10/2002 Allegro et al.
2004/0057591 A1 3/2004 Beck et al.
2004/0101147 A1* 5/2004 Arndt et al. ..... 381/93
2004/0109578 A1 6/2004 Niederdrank et al.
2004/0252853 A1 12/2004 Blamey et al.
2005/0036629 A1 2/2005 Aubauer et al.
2005/0094827 A1 5/2005 McDermott et al.
2005/0111683 A1* 5/2005 Chabries et al. ..... 381/317

FOREIGN PATENT DOCUMENTS

DE 3733983 A1 4/1989
DE 102 28 632 B3 1/2004

(Continued)

OTHER PUBLICATIONS

Crozier, et al., "speech enhancement employing spectral subtraction and linear predictive analysis", Electronics Letters, 10th Jun. 1993, vol. 29, No. 12, pp. 1094-1095.*

(Continued)

*Primary Examiner* — Vivian Chin
*Assistant Examiner* — Leshui Zhang

(57) ABSTRACT

Feedback whistle in hearing devices is intended to be able to be suppressed without loss of output of the useful signal. To this end, it is provided to establish or predetermine a frequency range which is susceptible to feedback. From an input signal which has a spectral component in the frequency range susceptible to feedback, a predeterminable component is substituted with a synthetic signal. Mixing-in a synthetic signal is also possibly used to widen the spectrum of an input signal, which is limited.

19 Claims, 2 Drawing Sheets

(56) References Cited

FOREIGN PATENT DOCUMENTS

| | | | |
|---|---|---|---|
| EP | 0415677 | B1 | 3/1991 |
| EP | 0969692 | A1 | 1/2000 |
| EP | 1216598 | B1 | 6/2002 |
| EP | 1 304 902 | A1 | 4/2003 |
| EP | 1471765 | A2 | 10/2004 |
| WO | 9525415 | A1 | 9/1995 |
| WO | 2005079109 | A1 | 8/2005 |
| WO | 2007/006658 | A1 | 7/2007 |

OTHER PUBLICATIONS

Kornagel, "Techniques for artificial bandwidth extension of telephone speech" Signal Processing, Elsevier Science Publishers B.V. Amsterdam, NL, Oct. 27, 2005, pp. 1296-1306, XP002457122.

Epps et al., "Techniques for artificial bandwidth extension of telephone speech" Speech coding Proceedings; 1999 IEEE Workshop on Porvoo; Finland, Jun. 20-23, 1999, pp. 174-176, Piscataway, NJ, USA; IEEE, XP010345554, ISBN: 0-7803-5651-9.

Kornagel, "Spectral widening of telephone speech using an extended classification approach" Proceedings of the European Signal Processing Conference, Bd. 2, 2002, pp. 339-342, XP008038635.

Kornagel, "Spectral widening of the excitation signal for telephone-band speech enhancement" International Workshop on Acoustic Echo and Noise Control, Sep. 2001, pp. 215-218 XP008038619.

Enbom et al., "Bandwidth expansion fo speech based on vector quantization of the mel frequency cepstral coefficients", Speech Coding Proceedings, 1999 IEEE Workshop on Porvoo, Finland, Jun. 20-23, 1999, Piscataway, NJ, USA; pp. 171-173, XP010345574, ISBN: 0-7803-5651-9.

* cited by examiner

METHOD FOR SUPPRESSING FEEDBACK AND FOR SPECTRAL EXTENSION IN HEARING DEVICES

CROSS REFERENCE TO RELATED APPLICATIONS

This application claims priority of German application No. 10 2006 020 832.3 filed May 4, 2006, which is incorporated by reference herein in its entirety.

FIELD OF THE INVENTION

The present invention relates to a method for suppressing feedback whistle in hearing devices and a method for spectral extension an input signal having a limited frequency range in a hearing device. Moreover, the present invention relates to corresponding hearing devices.

BACKGROUND OF THE INVENTION

In acoustic systems and, in particular, in hearing aids with at least one input (for example a microphone) and at least one output (for example an earpiece) there is the risk of acoustic feedback. With sufficiently high amplification, the system starts to oscillate which is made noticeable by whistling.

Until now, the feedback whistle could, for example, be suppressed by so-called notch filters. With this approach, the loop gain is lowered at the frequency at which feedback whistle might occur. By means of this lowering, the amplitude condition for feedback whistle is no longer fulfilled.

A further possibility for suppressing feedback whistle is to carry out a corresponding signal compensation. With this feedback compensation approach, the feedback path is digitally simulated and its effect is compensated. These approaches for feedback reduction may, however, markedly corrupt the output signal audibly, in particular if the input stage of the acoustic system is only designed for a small spectral bandwidth.

Acoustic systems with a narrow-band input stage further have the drawback that the acoustic quality of the output signal is generally correspondingly low.

A method and a device for noise suppression in a redundant acoustic signal is known from the publication EP 1 304 902 A1. In this case, a sub-frequency range of the input signal, in which interference is concentrated, is removed. Subsequently, the intensity of the remaining input signal is split into an input signal element to be retained and an input signal element to be processed further. Due to the input signal element to be processed further, the removed sub-frequency range of the input signal is synthesized. Finally, the input signal element to be retained and the synthesized input signal element are combined to produce an output signal with reduced interference relative to the input signal.

SUMMARY OF THE INVENTION

The object of the present invention is, therefore, to improve the signal quality of acoustic systems which are susceptible to feedback and/or have an input stage that is relatively narrow band.

According to the invention, this object is achieved by a method for suppressing feedback whistle in a hearing device by establishing or predetermining a frequency range which is susceptible to feedback, and receiving an input signal with a spectral component in the frequency range susceptible to feedback, as well as reducing said spectral component of the input signal and mixing the reduced spectral component with a synthetic signal, so that in said spectral range the output of the complete signal substantially corresponds to the output before the reduction.

Therefore, according to the invention a hearing device is provided with a feedback suppression device and a signal input device for receiving an input signal, the feedback suppression device comprising a reduction unit for reducing a spectral component of the input signal and a mixing unit for mixing the reduced spectral component with a synthetic signal, so that in said spectral range the output of the complete signal corresponds substantially to the output before the reduction.

The idea underlying the invention is to substitute a component of an internal signal of the hearing device with a synthetic signal and to mix it therewith. By means of the substitution, the amplitude condition for the feedback whistle is no longer fulfilled.

Preferably, the synthetic signal is generated with a nonlinearity from the input signal. In this manner, in the desired frequency range a synthetic signal may be generated according to the input signal.

The synthetic signal may, for example, also be generated from the input signal by frequency shift. Also, as a result, a synthetic signal may be easily generated in the desired frequency range according to the input signal.

Advantageously, the spectral envelope of a signal mixed from the synthetic signal and a component of the input signal is corrected by means of an LPC analysis. Thus the signal character of the original input signal may be easily maintained without feedback. For example, the correction may be carried out in combination with a common form filter.

According to a particular embodiment of the present invention, a further processing of the reduced signal is carried out before mixing and the mixing is carried out by adding the synthetic signal to the further processed, reduced signal immediately before a signal output to an output transducer. Thus the suppression of the feedback whistle may be carried out completely independently of the internal signal processing. This means that existing systems may also be easily retrofitted.

Moreover, the input signal may be processed in a plurality of channels, the substitution and/or mixing only being carried out in the channel with the frequency range susceptible to feedback. Thus the effect of the feedback suppression may be specifically restricted to one or more channels. Thus it is advantageous if one or more respective features of the respective signal are obtained from at least two of the channels and are considered for the substitution and/or mixing. Using the features from the other channels, therefore, the quality of the synthetic signal may be improved.

To solve the aforementioned object, a method is further provided for the spectral extension in a hearing device by receiving an input signal, the spectrum thereof having, a priori, a limited frequency range, and mixing the input signal or the input signal in a further processed form with a synthetic signal, the spectrum thereof being located at least partially outside the limited frequency range.

Moreover, according to the invention a corresponding hearing device is provided with a signal input device for receiving an input signal, the spectrum thereof having, a priori, a limited frequency range, and a mixing device for mixing the input signal or the input signal in a further processed form with a synthetic signal, the spectrum thereof being located at least partially outside the limited frequency range.

By mixing the input signal according to the invention with a synthetic signal, a spectral extension is achieved which leads to an output signal which is regarded as of higher qualitative value. In this connection, the spectral extension is achieved by a relatively low expenditure on hardware. Moreover, with certain acoustic systems, in which there are restrictions to the bandwidth of the input stage, for technical reasons, the spectral extension according to the invention is used so that the bandwidth is also not restricted in the output signal.

According to a preferred embodiment, the synthetic signal is generated by copying a component from the limited frequency range of the input signal. Specifically, mirror frequencies may be used during copying. Thus an input signal dependency of the synthetic signal may be easily generated.

According to a further embodiment of the system and/or method according to the invention, the mixing of the input signal with the synthetic signal may be interrupted, if non-linear behavior of the hearing device is detected. In this manner a noise-like feedback signal is able to be prevented which would no longer be interrupted by itself.

BRIEF DESCRIPTION OF THE DRAWINGS

The present invention is now described in more detail with reference to the accompanying drawings, in which.

DETAILED DESCRIPTION OF THE INVENTION

The exemplary embodiments described in more detail below represent preferred embodiments of the present invention.

According to the basic idea of the invention, signal components which cause the feedback whistle are intended to be substituted. This signal substitution is intended to be carried out in the frequency range susceptible to feedback. In this frequency range, therefore, the signal received by the microphone is not exclusively processed and emitted via the earpiece, but also the synthetically generated signal is processed and/or emitted. Thus the feedback loop may be interrupted and with linear system behavior undesirable oscillation may be prevented.

The signal received by the microphone may be mixed with the synthetic signal in any ratio. This mixing may also be considered as partial substitution. The effective gain may therefore be reduced in the feedback loop to such an extent that the amplitude condition for feedback is no longer fulfilled. As a result, a certain component of the natural signal remains.

Measures for generating synthetic signal components are, for example, the use of non-linearities, i.e. non-linear components with for example a quadratic characteristic, value characteristic etc. or modulation approaches in which frequency components are spectrally shifted. Primarily in the low frequency position (<8 kHz) a device for the correction of the spectral envelope should additionally be provided, in order to maintain a natural tone as far as possible. A tool for this purpose is, for example, LPC analysis (linear predictive coding) in combination with form filtering.

Advantageously it suffices to know, with the suppression of feedback whistle according to the invention, in which frequency band feedback whistle occurs and/or may occur. The target output is not reduced in the relevant frequency band, as with the notch filter approach. Instead, with the signal substitution according to the invention in the frequency band in which feedback whistle occurs, practically no output is lost. Moreover, the feedback path in the solution according to the invention does not have to be explicitly known, as is necessary with the feedback compensation approach.

Figure 1:
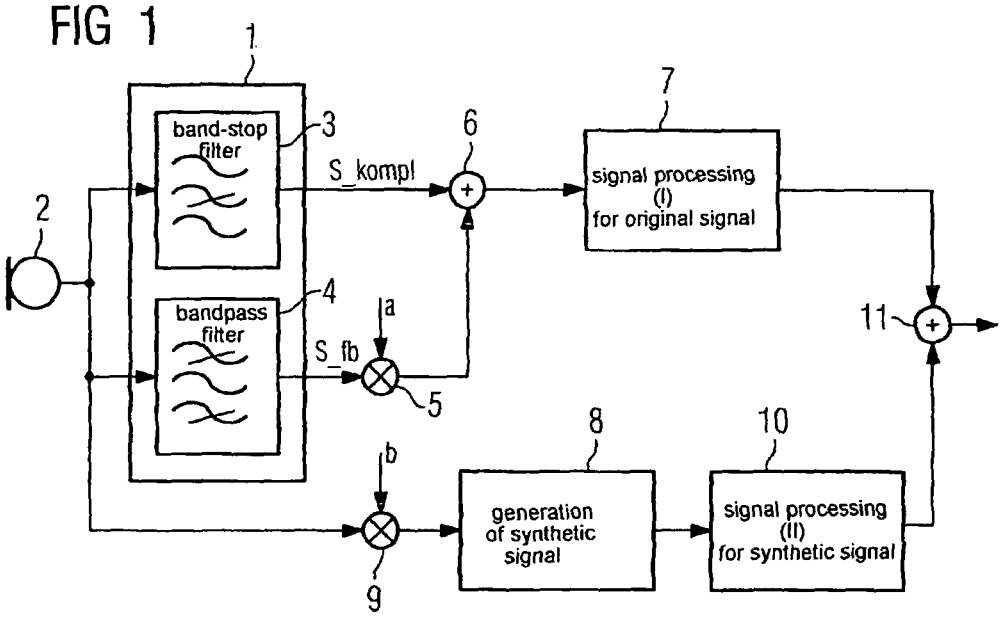
FIG. 1 shows an elementary circuit diagram of a hearing device according to a first embodiment of the present invention and FIG. 2 shows an elementary circuit diagram for subband synthesis of a multichannel device according to the invention.

In FIG. 1 a practical exemplary embodiment is proposed. In a switch 1 the original input signal of a microphone 2 is divided into two complementary spectral ranges. In the present case, the switch 1 contains a bandstop filter 3 and a bandpass filter 4. As a result, the signal is divided into a bandpass signal S_fb and into a spectrally complementary signal S_kompl. Instead of the bandpass filtering, low-pass or high-pass filtering may also be used.

The spectral range of the bandpass signal S_fb represents the band in which feedback whistle would occur without counter measures. The bandpass signal S_fb is multiplied in a multiplier 5 by a factor a. Multiplied by this factor a (with $0<a<1$) the bandpass signal S_fb is again partially added to the complementary signal S_kompl in the adder 6. The signal thus obtained passes through the regular signal processing 7 through which the original signal might pass without compensation measures for feedback whistle.

The output signal of the microphone 2 is also used for generating the synthetic signal in the spectral range of the bandpass signal S_fb according to the lower path of FIG. 1. For example, by means of a filter a suitable spectral band is cut out and copied into the relevant spectral band. Appropriate means for generating a synthetic signal 8 are represented in the lower path of the circuit diagram of FIG. 1. The synthetic signal is weighted by a factor b. This weighting by means of a multiplier 9 may be carried out before the input into the means for generating the synthetic signal 8. Subsequently, the synthetic signal is adapted by means of a signal processing module 10 such that it may be added to the signal of the signal processing 7 of the upper path. This addition takes place in an adder 11 immediately before the signal output to an output transducer, not shown in FIG. 1.

The factors a and b are adjusted relative to one another. They define the mixing ratio of the synthesized and real signal component in the spectral range of the band pass signal S_fb. The larger the factor a, the smaller the factor b has to be and vice versa, so that the feedback whistle may be suppressed. In a first extreme case, a is close to 1 and b close to 0, so that practically no signal substitution is carried out by a synthetic signal in the spectral range of the bandpass signal S_fb. In a second extreme case, a is close to 0 and b close to 1, whereby an almost complete signal substitution is carried out by the synthetic signal in the spectral range of the bandpass signal S_fb.

Figure 2:
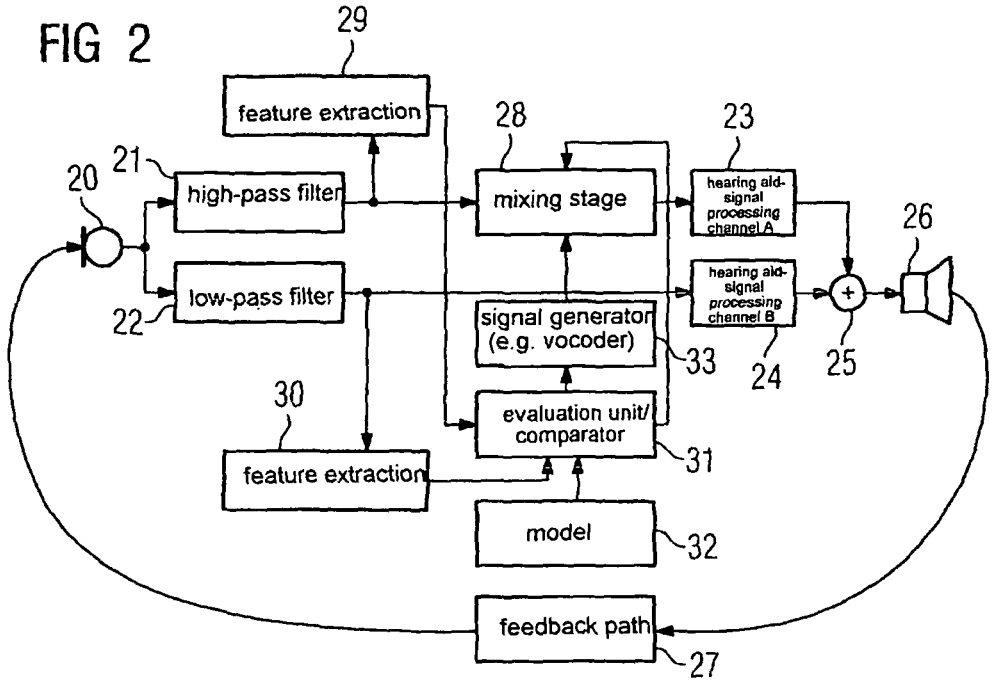

According to a development of the exemplary embodiment of FIG. 1, features of the original signal may be extracted from the signals of the upper path. With these features, a correction of the spectral envelope in the synthesized band may be achieved. In FIG. 2 a circuit diagram of a multichannel device is reproduced with subband synthesis and feature extraction. The output signal of a microphone 20 is, in turn, split into two channels. To this end, for example a high-pass filter 21 serves as a first filter and, for example a low-pass filter 22 serves as a second filter. The high-pass signal corresponds to a channel A and the low-pass signal corresponds to a channel B. A hearing aid signal processing unit 23 is arranged in channel A and a hearing aid signal processing unit 24 is arranged in channel B. The output signals of the two signal processing units 23 and 24 are added together in an adder 25 and the total signal sent to an earpiece 26.

A component of the acoustic output signal of the earpiece 26 is fed back via a feedback path 27 to the microphone 20. As the feedback takes place first in the high frequency channel A, a mixing stage 28 is arranged between the high-pass filter 21 and the hearing device signal processing unit 23, by means of which a synthetic signal may be mixed into the high frequency channel. For generating the synthetic signal, one or more features of the high frequency channel A are obtained by a feature extraction unit 29 and also one or more features of the low frequency channel B are obtained by a feature extraction unit 30. The features obtained by the units 29 and 30 are evaluated and/or compared in an evaluation unit 31. A model 32 forms the basis of the evaluation unit 31. This model contains prior knowledge about ratios of components in the high-pass range to components in the low-pass range. The evaluation unit 31 thus establishes, for example with reference to the spectral envelope which is provided as a feature from the high frequency channel A, and from the model 32, a mixing ratio for the mixing stage 28. Moreover, the evaluation unit 31 activates a signal generator 33, for example a vocoder. The signal generator 33 then delivers the synthetic signal to the mixing stage 28.

The example of FIG. 2 shows a two-channel hearing aid. The invention may, however, also be used for any other device with two or more channels.

Said mixing and/or substitution may also be used for a spectral extension. For example, in an acoustic system with at least one input (for example a microphone, receiver) and at least one output (for example an earpiece) one or more frequency ranges of the signal to be output are synthetically generated. Thus the input stage of the acoustic system may be designed for a lower spectral bandwidth and/or in systems having input stages that are not able to exceed a specific bandwidth for technical reasons, it is possible to extend the bandwidth of the output signal to a larger target bandwidth. It is advantageous that the spectral extension is possible with a relatively low expenditure on hardware. Moreover, restrictions to the bandwidth of the input stage, for technical reasons, do not restrict the bandwidth of the output signal.

In this case a wireless audio link is mentioned as a practical example. The restricting element in the input stage is the receiver, which provides a maximum frequency of 8 kHz. As frequencies of up to 12 kHz are required in high fidelity operation, the band is synthetically generated from 8 kHz to 12 kHz.

A further variant for the spectral extension according to the invention relates to hearing aids. The synthetic generation of spectral components above 8 kHz is very advantageous for hearing aids, as above this frequency there is the risk of feedback whistle. Even without the correction of the spectral envelope, by copying lower frequency bands into the band above 8 kHz an obvious spectral extension may be perceived. For example, the use of mirror frequencies outside the nyquist band may serve as a copying method, the "by-products" of frequency shift processes being specifically utilized.

Even when a frequency band is occupied by synthetic spectral components, and thus in this band no feedback whistle is able to arise in the traditional sense (oscillation of an unstable, linear, time invariant system), with correspondingly high gain, however, a comparable feedback phenomenon results. More specifically, real systems behave primarily in a non-linear manner on the modulation depth limit. The reason therefor is, for example, the non-linear behavior of hardware components, for example earpieces or microphones, but also non-linearities in the digital signal processing, for example hard limiters or AGCs. If the synthetic spectral components from natural spectral components are diverted from outside the frequency band to be synthetically occupied, a closed feedback loop may occur in the following manner: a synthetic spectral component is generated from a natural spectral component according to a predetermined algorithm; non-linearity with interference generates, in turn, spectral components outside the band with synthetic spectral components; the newly generated spectral components are thus fed back to the microphone; the newly generated spectral components also serve, in turn, as a basis for generating synthetic spectral components, whereby the loop is closed. In an extreme case, a noise-like feedback signal is thus produced which is no longer interrupted by itself.

A solution for the noise-like feedback signal may, however, be produced by the non-linear behavior of the system, for example, being established by overload detection. If the system behaves in a non-linear manner for a certain time (for example moved in overload) the synthetic generation (for example <1 second) is briefly interrupted, so that the self-stabilized feedback noise may be interrupted.

Figure 3:
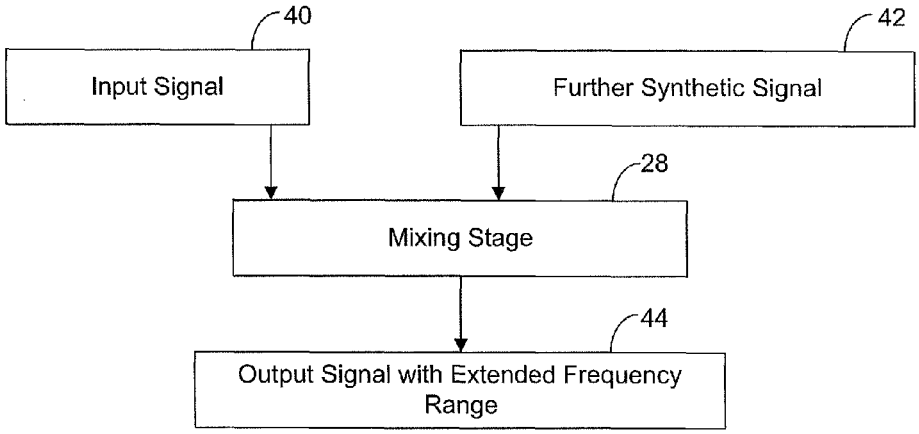
FIG. 3 is an example of a signal mixing representation in connection with a mixing stage embodying aspects of the present invention.

As shown in FIG. 3, in one example embodiment mixing stage 28 may be arranged to mix input signal 40 with a further synthetic signal 42 to supply an output signal 44 that extends the frequency range of the input signal.

Figure 4:
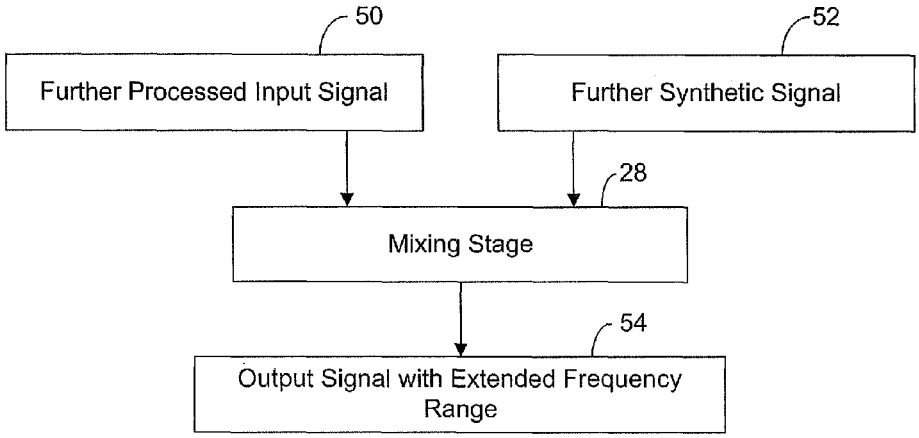
FIG. 4 is another example of a signal mixing representation in connection with a mixing stage embodying aspects of the present invention.

As shown in FIG. 4, in another example embodiment mixing stage 28 may be arranged to mix a further processed input signal 50 with a further synthetic signal 52 to supply an output signal 54 that extends extend the frequency range of the input signal.

The invention claimed is:

1. A method for suppressing a feedback whistle in a hearing aid device, comprising:

predetermining a frequency range that is susceptible to the feedback whistle in the hearing aid device;

receiving, by the hearing aid device, an input signal having a frequency spectrum including a spectral component in the frequency range susceptible to the feedback whistle in the hearing aid device;

reducing the spectral component in the frequency range susceptible to the feedback whistle in the hearing aid device to generate a reduced spectral component of the input signal;

generating, in a synthetic signal generator, a synthetic signal that is adapted to mix with the reduced spectral component of the input signal and the mixing with the reduced spectral component of the input signal arranged in the frequency range susceptible to the feedback whistle in the hearing aid device, wherein the generating of the synthetic signal, in the synthetic signal generator, further comprises:

extracting at least one feature of a high-frequency spectral component and a low-frequency spectral component of the input signal;

evaluating the at least one extracted feature according to a prior knowledge of ratios of the high-frequency spectral component to the low-frequency spectral component derived from a model;

establishing a mixing ratio according to the evaluated at least one extracted feature;

activating a delivery of the generated synthetic signal to a mixing stage;

mixing, at the mixing stage, the reduced spectral component of the input signal with the generated and delivered synthetic signal to generate a mixed input signal, based on the established mixing ratio, so that a frequency spectrum of the mixed input signal substantially corresponds to the frequency spectrum of the input signal before the reduction of the spectral component of the input signal with a suppressed feedback whistle in the hearing aid device;

processing the mixed input signal to generate an output signal; and outputting the output signal.

2. The method as claimed in claim 1, wherein the synthetic signal is generated non-linearly from the input signal.

3. The method as claimed in claim 1, wherein the synthetic signal is generated from the input signal by frequency shifting.

4. The method as claimed in claim 1, wherein a spectral envelope of the mixed input signal is corrected by a linear predictive coding analysis.

5. The method as claimed in claim 4, wherein the correction is combined with filtering.

6. The method as claimed in claim 1, wherein the reduced spectral component of the input signal is further processed before mixing and the generated and delivered synthetic signal is mixed to the further processed reduced spectral component of the input signal immediately before outputting to an output transducer.

7. The method as claimed in claim 1, wherein the input signal is processed in a plurality of channels and the generated and delivered synthetic signal is only mixed in one channel with the frequency range susceptible to the feedback whistle in the hearing aid device.

8. The method as claimed in claim 7, wherein one or more features of the input signal is obtained from at least two of the channels and evaluated to provide a mixing ratio for the mixing.

9. A method for extending a spectrum of an input signal in a hearing aid device, comprising:

receiving, by the hearing aid device, an input signal having a spectral component in a first frequency range;

generating, in a synthetic signal generator, a synthetic signal adapted to mix with a reduced spectral component of the input signal, wherein the generating of the synthetic signal further comprises:

extracting at least one feature of a high-frequency spectral component and a low-frequency spectral component of the input signal;

evaluating the at least one extracted feature according to a prior knowledge of ratios of the high-frequency spectral component to the low-frequency spectral component derived from a model;

establishing a mixing ratio according to the evaluated at least one extracted feature;

activating a delivery of the generated synthetic signal to a mixing stage;

mixing, at the mixing stage, the input signal with the generated and delivered synthetic signal to generate a mixed input signal, based on the established mixing ratio so that the spectrum is extended to a second frequency range at least partially outside the first frequency range;

momentarily interrupting the generating of the synthetic signal when a non-linear characteristic of the hearing aid device is detected, said momentary interrupting of the generating of the synthetic signal being configured to interrupt a feedback loop of the hearing aid device;

processing the input signal having the extended spectrum; and outputting the processed input signal.

10. The method as claimed in claim 9, wherein the synthetic signal is generated by copying a component from the first frequency range of the input signal.

11. The method as claimed in claim 10, wherein the copying comprises mirroring frequencies.

12. The method as claimed in claim 9, wherein a spectral envelope of the mixed input signal is corrected by a linear predictive coding analysis.

13. The method as claimed in claim 9, wherein the input signal is mixed with the generated and delivered synthetic signal immediately before outputting to an output converter.

14. The method as claimed in claim 9, wherein the input signal is further processed and the generated and delivered synthetic signal is mixed with the further processed input signal.

15. A hearing aid device to be worn by a user, comprising:

a signal input unit to receive an input signal having a frequency spectrum;

a reduction unit to reduce a spectral component in the frequency spectrum of the input signal; and a synthetic signal generator to generate a synthetic signal adapted to mix with the reduced spectral component of the input signal and the mixing with the reduced spectral component of the input signal arranged in a frequency range susceptible to a feedback whistle in the hearing aid device;

at least one feature extraction unit configured to extract at least one feature of a high-frequency spectral component and a low-frequency spectral component of the input signal;

an evaluation unit configured to:

evaluate the at least one extracted feature according to a prior knowledge of ratios of the high-frequency spectral component to the low-frequency spectral component derived from a model;

establish a mixing ratio according to the evaluated at least one extracted feature and;

activate a delivery of the generated synthetic signal to a mixing stage;

a mixing unit, at the mixing stage, to mix the reduced spectral component of the input signal with the generated and delivered synthetic signal to generate a mixed input signal, based on the established mixing ratio, so that a frequency spectrum of an output signal of the mixing unit substantially corresponds to the frequency spectrum of the input signal before the reduction of the input signal with a suppressed feedback whistle in the hearing aid device.

16. The hearing aid device as claimed in claim 15, wherein the input signal has a limited frequency range.

17. The hearing aid device as claimed in claim 16, wherein the mixing unit mixes the input signal with a further synthetic signal to extend the frequency range of the input signal.

18. The hearing aid device as claimed in claim 17, wherein the input signal is further processed before mixing.

19. The hearing aid device as claimed in claim 18, wherein the mixing unit mixes the further processed input signal with the further synthetic signal to extend the frequency range of the input signal.

* * * * *